US005957367A

United States Patent [19]

Matsuo et al.

[11] Patent Number: 5,957,367

[45] Date of Patent: Sep. 28, 1999

[54] CONTINUOUS ROLLING METHOD OF BILLET AND APPARATUS THEREFOR

[75] Inventors: Giichi Matsuo; Susumu Okawa, both of Yokohama, Japan

[73] Assignee: NKK Corporation, Tokyo, Japan

[21] Appl. No.: 08/848,313

[22] Filed: Apr. 30, 1997

[30] Foreign Application Priority Data

May 7, 1996 [JP] Japan ..... 8-112260
May 14, 1996 [JP] Japan ..... 8-119334

[51] Int. Cl.[6] ..... B23K 37/00; B21B 1/24

[52] U.S. Cl. ..... 228/158; 228/5.7

[58] Field of Search ..... 228/5.7, 158, 49.1

[56] References Cited

U.S. PATENT DOCUMENTS

| | | | |
|---|---|---|---|
| 4,294,394 | 10/1981 | Iida et al. | 228/5.7 |
| 4,850,522 | 7/1989 | Nichols | 228/5.7 |
| 5,172,846 | 12/1992 | Hayashi et al. | 228/5.7 |

FOREIGN PATENT DOCUMENTS

| | | | |
|---|---|---|---|
| 28 36 338 | 2/1980 | Germany . | |
| 52-43754 | 4/1977 | Japan . | |
| 57-11722 | 3/1982 | Japan . | |
| 784 225 | 9/1957 | United Kingdom . | |
| 800860 | 9/1958 | United Kingdom . | |
| 94/29073 | 12/1994 | WIPO | 228/49.1 |

OTHER PUBLICATIONS

Patent Abstracts of Japan, vol. 016, No. 346 (M–1286), Jul. 27, 1992 & JP 04–105701 A (Hitachi Ltd.), Apr. 7, 1992, Abstract.

Patent Abstracts of Japan, vol. 003, No. 011 (C–035) Jan. 30, 1979 & JP 53–135863 A (Nippon Steel Corp.), Nov. 27, 1978, Abstract.

Stahl und Eisen, vol. 78, No. 16, Aug. 7, 1958, pp. 1130–1132, XP002028237, Weidemann, H.: "Das Auswalsen 'Endlos' Zisammengeschweisster Knueppel"—Figures 2, 3.

*Primary Examiner*—Samuel M. Heinrich
*Assistant Examiner*—Jeffrey T. Knapp
*Attorney, Agent, or Firm*—Frishauf, Holtz, Goodman, Langer & Chick, P.C.

[57] ABSTRACT

A continuous rolling method includes the steps of: flash-butt welding a rear end of a preceding billet with a front end of a succeeding billet; grinding the welded portion to remove a burr on the welded portion; heating the continuous billet; and rolling the continuous billet through a series of rolling mills. The flash-butt welding step includes joining the rear end of the preceding billet with the front end of the succeeding billet by using the stationary welder and joining the billets having at least double the length of the preceding billet by using the travelling welder. A continuous rolling apparatus includes a stationary flash-butt welder, a travelling flash-butt welder, a travelling grinding machine, an induction heater and a series of continuous rolling mills.

14 Claims, 9 Drawing Sheets

CONTINUOUS ROLLING METHOD OF BILLET AND APPARATUS THEREFOR

BACKGROUND OF THE INVENTION

1. Field of the Invention

The present invention relates to a method for continuously rolling billets and an apparatus therefor.

2. Description of the Related Arts

A Conventional method of continuous rolling aiming at the manufacture of wires, rods, or shape steels at a high efficiency and with decreased energy comprises the steps of: discharging billets one at a time from the heating furnace, welding the rear end of preceding billet with the front end of succeeding billet using a single travelling flash-butt welding machine, removing the burrs at the welded portion using a scarfer or the like, heating thus prepared continuous billet to a specified temperature necessary for rolling in an induction heating unit, then continuously rolling the continuous billet in a rolling mill line. (For example, unexamined Japanese patent publication No. 52-43754 discloses the conventional method.) In a hot direct-rolling process (HDR process) same line, the billets are all directly sent from a continuous casting machine are continuously rolled by a single travelling flash-butt welding machine. (For example, examined Japanese patent publication No. 57-11722 discloses this method.)

In the billet continuous rolling process, the shortening of cycle time for treating a single billet is a critical variable. The weight of a single billet usually used is in a range of from 0.5 to 2 tons. To increase the production capacity to a level ranging from 70 to 80 ton/hour or more, the necessary cycle time for processing a single billet is 1 min. or less.

Conventional continuous rolling processes, however, use only one travelling welder on the manufacturing line. Since further shortening of welding time for treating a billet inherent to a travelling welder is difficult, the realization of a cycle time of 1 min. or less is impossible using conventional methods.

SUMMARY OF THE INVENTION

It is an object of the present invention to provide a continuous rolling method of a billet and an apparatus therefor wherein a cycle time for processing the billet can be shortened.

To attain the object, the present invention provides a first continuous rolling method of billet comprising the steps of: flash-butt welding, grinding, heating and continuously rolling. In the step of flash-butt welding, a rear end of a preceding billet and a front end of a succeeding billet are joined to produce a continuous billet having a welded portion. In the grinding step, a burr generated on the welded portion is removed. In the heating step, the continuous billet from which the burr was removed. In the step of continuously rolling, the continuous billet is continuously rolled through a series of rolling mills.

The step of flash-butt welding comprises a providing step, a first joining step and a second joining step. In the providing step, a stationary welder and a travelling welder are provided. The stationary welder and the travelling welder are arranged in series. In the first joining step, the rear end of the preceding billet and the front end of the succeeding billet are joined by using the stationary welder to produce a double-length billet having at least double the length of the preceding billet. In the second joining step, the double-length billet is joined to a preceding continuous billet to form the continuous billet.

Further, the present invention provides a continuous rolling apparatus of a billet comprising: a stationary flash-butt welder, a travelling flash-butt welder, a travelling grinding machine, an induction heater and a continuous rolling mill. The stationary flash-butt welder joins billets to a double-length billet having at least double the length of the billet having a first welded portion. The travelling flash-butt welder joins the double-length billet to a preceding continuous billet to form the continuous billet having a second welded portion. The stationary flash-butt welder and the travelling flash-butt welder are arranged in series. The travelling grinding machine removes burrs on the first welded portion and the second portion. The induction heater heats the continuous billet from which the burr was removed. The continuous rolling mill rolls continuously the heated continuous billet.

Furthermore, the present invention provides a second continuous rolling method of billet comprising the steps of: flash-butt welding, grinding, heating and continuously rolling. In the step of flash-butt welding, a rear end of a preceding billet and a front end of a succeeding billet are joined to produce a continuous billet having a welded portion. In the grinding step, a burr generated on the welded portion is removed. In the heating step, the continuous billet from which the burr was removed. In the step of continuously rolling, the continuous billet is continuously rolled through a series of rolling mills.

The step of flash-butt welding comprises a providing step, a first joining step, an intermittently transferring step and a second joining step. In the providing step, a stationary welder is provided in a first line and a travelling welder is provided in a second line. The first line is different from the second line. The second line matches the rolling line. In the first joining step, the rear end of the preceding billet and the front end of the succeeding billet are joined by using the stationary welder to produce a double-length billet having at least double the length of the preceding billet. In the second joining step, the double-length billet is joined to a preceding continuous billet to form the continuous billet.

Moreover, the present invention provides a continuous rolling apparatus of a billet comprising: a stationary flash-butt welder arranged in a first line, a travelling flash-butt welder arranged in a second line, a travelling grinding machine, an induction heater and a continuous rolling mill. The second line is connected to the first line in parallel or at right angle to the first line via a line-connecting unit. The stationary flash-butt welder joins billets to a double-length billet having at least double the length of the billet having a first welded portion. The travelling flash-butt welder joins the double-length billet to a preceding continuous billet to form the continuous billet having a second welded portion. The travelling grinding machine removes burrs on the first welded portion and the second welded portion. The induction heater heats the continuous billet from which the burr was removed. The continuous rolling mill rolls continuously the heated continuous billet.

DESCRIPTION OF THE EMBODIMENT

EMBODIMENT 1

Figure 1:
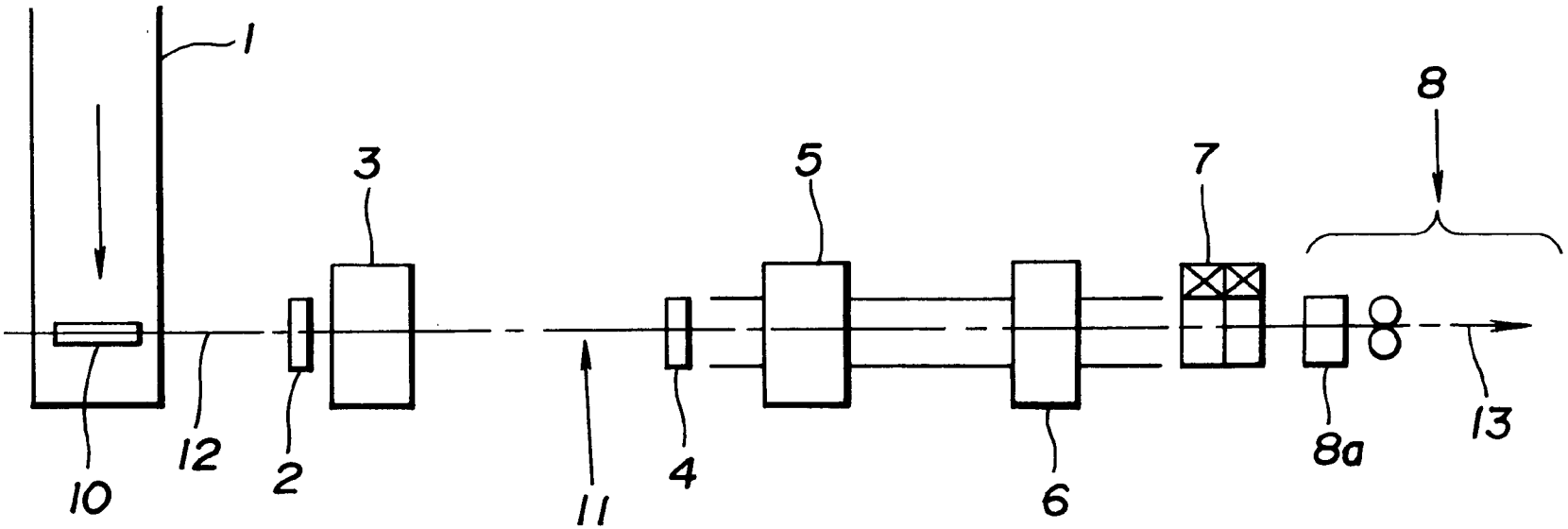
FIG. 1 is a schematic drawing of a manufacturing line of the continuous rolling process of embodiment 1-1 according to the present invention.

The continuous rolling method according to the embodiment 1 comprises the steps of: flash-butt welding a rear end of a preceding billet with a front end of a succeeding billet; grinding a welded portion to remove burrs therefrom; heating the joined continuous billet; and continuously rolling the continuous billet through a series of rolling mills. In the flash-butt welding step, a stationary welder and a travelling welder are used as welders. The stationary welder and the travelling welder are arranged in series. The flash-butt welding step includes a first joining step and a second joining step. In the first joining step, the billets are joined to at least double the length of an original single billet using the stationary welder. In the second joining step, the joined double-length billet is joined to a preceding continuous billet using the travelling welder.

Since the stationary welder joins billets each having a unit weight to at least double the length of an original single billet, the travelling welder is requested only to join these double-length billets. Accordingly, the flash-butt welding time has a sufficient margin. As a result, the cycle time for processing the billets can be reduced.

In the second joining step where the travelling welder functions, the billet feed speed is controlled in a manner that the feed speed of the preceding continuous billet in the second joining step is set to the same speed of entering thereof to the first stand in the rolling mill line, and that a feed control is given so as the succeeding double-length billet to catch up with the preceding continuous billet at a point of weld-start in the second step. The control avoids the billets from receiving excessive force and allows the implementation of continuous welding and continuous rolling of billets.

The method according to the embodiment 1 is applicable to a continuous rolling process using a heating furnace or to a hot direct-rolling process directly connected to a continuous casting machine. According to the former process, a heating furnace is located at upstream side of the stationary welder, and billets are discharged from the heating furnace at nearly fixed time interval shorter than the welding time in the second joining step. The latter process is particularly effective in such a case that, owing to the limitation of building shape and size, the arrangement of a continuous casting machine for multiple-train casting unavoidably requires to cut the billets to a short length. According to the latter process, a continuous casting machine which makes billets in a plurality of strands is located at upstream side of the stationary welder, and billets which were cut to a relatively short length are discharged from the heating furnace via a line-connecting unit at a nearly fixed time interval shorter than the welding time in the second joining step. The line-connecting unit is the one to connect the casting line of the continuous casting machine with the billet-continuation line, and the line-connection unit includes a turn table, a transfer conveyer, and a shift vehicle.

According to the hot direct-rolling process, no heating furnace is necessary, and the heat of billets is effectively used, so the billets are required only to be heated from about 920° C. at the exit of the continuous casting machine to the rolling temperature, or about 1020° C., using an induction heating unit, which accounts for about 100° C. of heating. As a result, the unit requirement for heating is significantly reduced.

A continuous rolling apparatus according to the embodiment 1 comprises: a stationary flash-butt welder, a travelling flash-butt welder, a travelling grinding machine, an induction heating unit and a series of rolling mills. The stationary flash-butt welder joins billets to at least double the length of an original single billet. The travelling flash-butt welder welds the double-length billet to a preceding continuous billet. The travelling grinding machine grinds burrs on each welded portion. The induction heating unit heats the continuous billet. The series of rolling mills continuously rolls a continuously joined billet. The stationary flash-butt welder, the travelling flash-butt welder, the travelling grinding machine, and the induction heating unit are arranged in this sequence order from upstream side of a series of rolling mills. The stationary welder and the travelling welder are installed in series.

Further, the continuous rolling apparatus according to the embodiment 1 has an arrangement of: a billet heating furnace at upstream side of the stationary flash-butt welder or a continuous casting machine which makes billets in a plurality of strands, and a line-connecting unit which intermittently connects billets which were cut to a relatively short length to the stationary welding machine, both of the continuous casting machine and the line-connecting unit being arranged at upstream side of the stationary welding machine.

Embodiment 1-1

FIG. 1 is a schematic drawing of a manufacturing line of the continuous rolling process in the embodiment 1-1. The line includes a heating furnace 1, a descaler 2, a stationary flash-butt welder 3 (hereinafter referred to simply as "the stationary welder"), a descaler 4, a travelling flash-butt welder 5 (hereinafter referred to simply as "the travelling welder"), a travelling grinding machine 6, an induction heating unit 7, a continuous rolling mill 8, and a first stand 8*a*.

The continuation line 12 of billets 10 and the rolling line 13 of the continuous rolling mill 8 match each other. A series of the above-descried units starting from the descaler 2 to the continuous rolling mill 8 are arranged on thus formed straight manufacturing line 11, and the stationary welder 3 and the travelling welder 5 are located in series.

The following is outline of method for joining billets in the continuous rolling apparatus configured as described above.

The billets 10 having a standard length are heated while passing through the heating furnace 1. Then the billets are discharged from the heating furnace 1 one at a time. After the first billet 10 is treated by the descaler 2 to remove scale on its front end and rear end, it is sent to the stationary welder 3, where the billet is stopped in the stationary welder matching the rear end thereof to the center position of the stationary welder. The positioning to stop may be done by a tracking control of a feed table or by a disappearing stopper. A billet 10 succeedingly discharged from the heating furnace 1 is sent to the stationary welder 3 via the descaler 2 in a same manner as the preceding billet 10, and the front end of the second billet is welded to the rear end of the first billet in the stationary welder 3 by the flash-butt welding. Thus, a billet having double-length to original one is formed as the first double-length billet.

The first double-length billet passes through the descaler 4, where the scale at front end and rear end thereof is removed. Then, the double-length billet enters the travelling welder 5, and is stopped therein. Feed control is then performed to enable the second double-length billet which was formed in the stationary welder 3 in a similar manner to catch up with the first double-length billet at a point of weld-start. Thus the first and second double-length billets are joined together by flash-butt welding. The resulted billet has four-fold length to the original one. That is, a 4L billet is obtained (L denotes the length of original single billet.)

Then the travelling welder 5 joins the 4L billet with succeeding 2L billet, and repeats the joining action to conduct continuous joining of billets.

The continuous billet thus formed is treated by the travelling grinding machine 6 to remove burrs at every welded portion, and is heated while passing through the induction heating unit 7 to a temperature necessary for rolling, or about 1020° C. And the continuous billet is continuously rolled in the continuous rolling mill 9.

Figure 2:
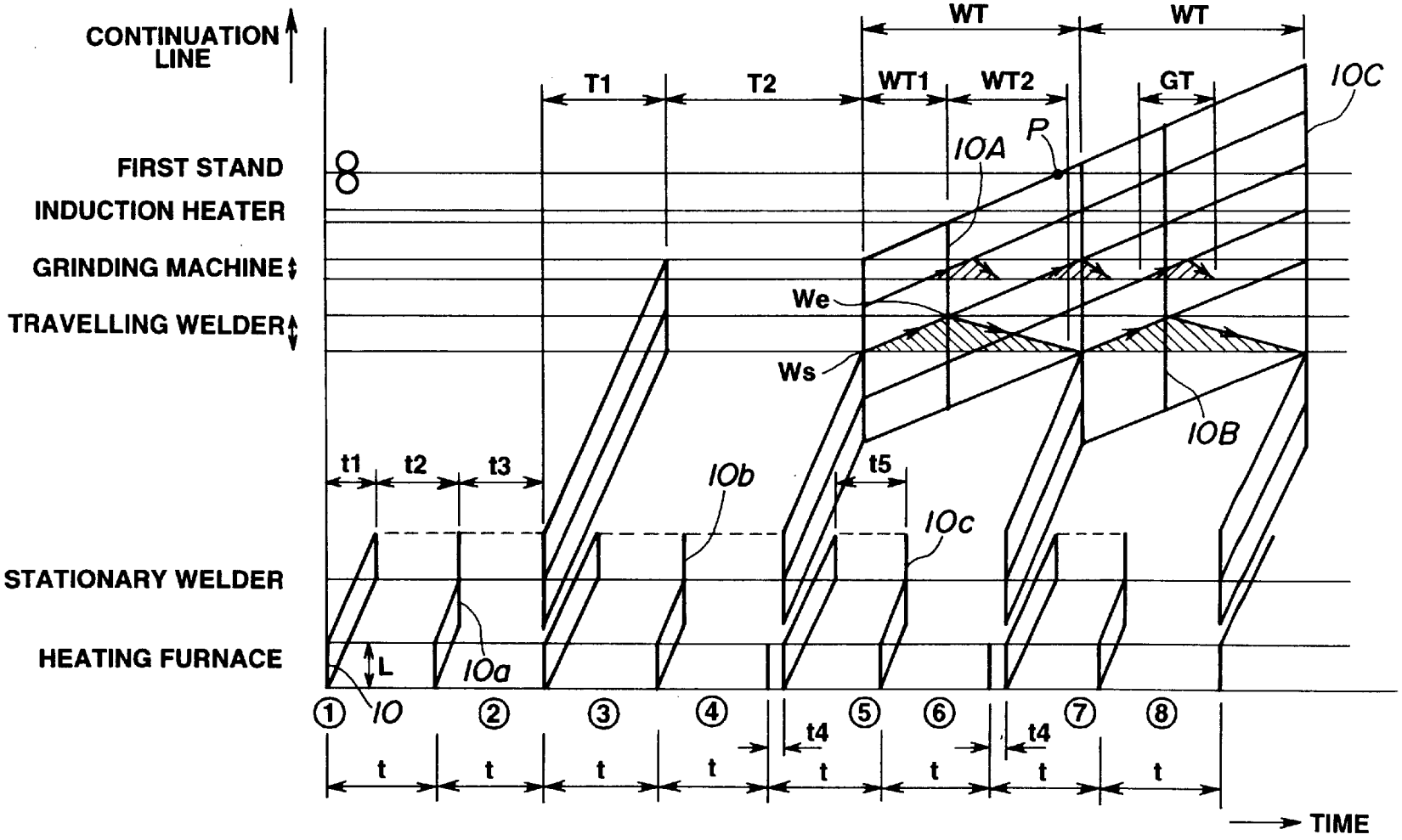
FIG. 2 is a time chart for embodiment 1-1.

The sequential actions described above all described in more detail referring to a time chart given in FIG. 2. The time chart shows the relation between time along the horizontal axis and distance between major machines and arrangement thereof along the vertical axis.

According to the example time chart, the time interval for discharging billet is 30 sec. The symbols ①, ②, . . . , ⑧ on the horizontal axis indicate the sequential order of discharge of billets 10. The symbol L along the vertical axis expresses the length of an original single billet.

The first billet ① is discharged from the heating furnace 1, and is sent to the stationary welder 3 (feed time t1), then is stopped at the center position of the stationary welder 3 matching the rear end of the billet ① thereto (waiting time t2).

After 30 sec. have passed, the second billet ② is discharged from the heating furnace 1, and is joined with the first billet ① by flash-butt welding. The thus formed double-length (2L) billet 10*a* comes first to be transferred toward the travelling welder 6 (transfer time T1). The double-length billet stops to wait until the succeeding double-length billet 10*b* arrives (waiting time T2).

At nearly the same time that the first double-length billet 10*a* is started to move toward the travelling welder 5, the third billet ③ is discharged from the heating furnace 1, and the third billet ③ and the fourth billet ④ are joined together during the time T1 for transferring the double-length billet 10*a*. After the waiting time t2, the second double-length billet 10*b* is sent toward the travelling welder 5. At that moment, the feed of the double-length billet 10*b* is controlled so that the front end of the second double-length billet 10*b* catches up with the rear end of the first double-length billet 10*a* at the point Ws of weld-start. When the double-length billet 10*b* catches up with the double-length billet 10*a*, the travelling welder 5 begins to run, and the welding of the first double-length billet 10*a* and the second double-length billet 10*b* is completed at the point We. Then, the travelling welder 5 returns to the original position. The net welding time WT1 of the travelling welder 5 is about 24 sec., and the time chart is set to within 60 sec. of the total welding time WT including the returning time WT2. Thus, the first 4L billet 10A is fabricated. The feed speed of the 4L billet 10A is set to the entering speed of the billet into the first stand of the continuous rolling mill. The front end of the 4L billet 10A enters the first stand at the point P. The speed of the travelling welder 5 and that of the travelling grinding machine 6 are set to synchronize the billet entering speed to the first stand. Since the grinding time GT of burrs on a welded portion is significantly short, the grinding is sufficiently performed during the welding time.

The fifth billet ⑤ is scheduled to be discharged at a slightly delayed timing (at t4 of discharge delayed time), thus shortening the waiting time t5 to prevent the cooling thereof. The third double-length billet 10*c* which was formed by joining with the sixth billet ⑥ is joined to the preceding 4L billet 10A by the travelling welder 5, thus the billet is added by 2L length. That is, the billet 4L becomes a 6L billet 10B. Successive addition by 2L length provides 8L billet, 10L billet, and so on. Thus the billets becomes a continuous one, and the continuous billet is continuously rolled in the continuous rolling mill 8.

Accordingly, the travelling welder 5 needs to weld only 2L length portion, which gives a sufficient margin in the welding time inherent to the travelling welder. As a result, the welding is performed at a half cycle time compared with the cycle time of a single conventional travelling welder. The reason why the significant reduction in cycle time is achieved is that the stationary welder 3 prepares a billet with at least double length to the original one in advance.

Embodiment 1-2

Figure 3:
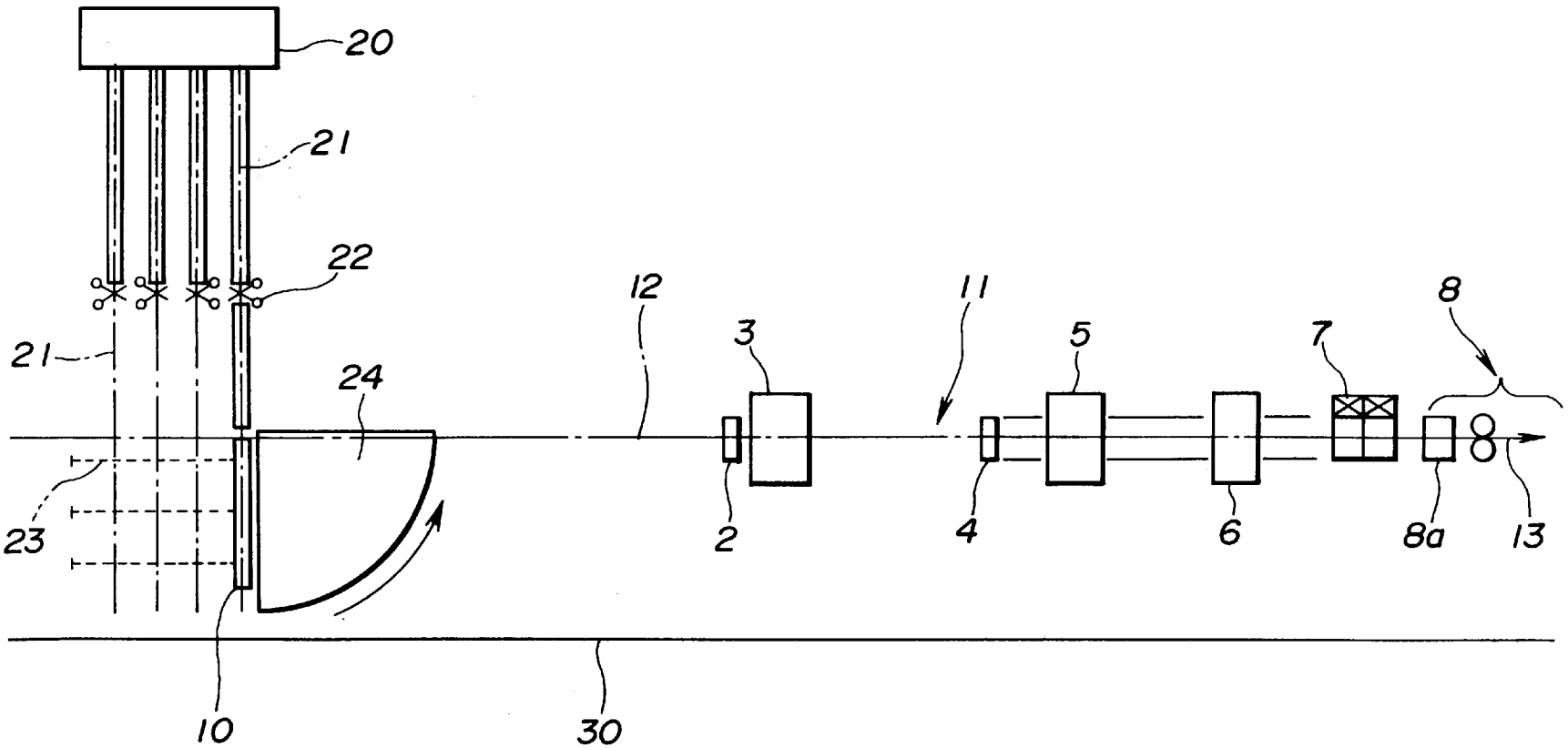
FIG. 3 is a schematic drawing of a manufacturing line of the continuous rolling process of embodiment 1-2 according to the present.

FIG. 3 is a schematic drawing of a manufacturing line of the continuous rolling process of embodiment 1-2 according to the present invention.

As described before, the present invention is also applicable to a hot direct-rolling process using a continuous casting machine. This example is for the case of hot direct-rolling process. A multiple-train continuous casting machine 20 is positioned in parallel with the rolling line 13 because of limitation of building 30 or the like, so the billets 10 have to be cut to a short length. Even for the case, the present invention is applicable only by installing the stationary welder 3 and the travelling welder 5 in tandem arrangement. FIG. 3 shows a casting line 21, a cutting machine 22, a set of chain conveyers 23 which transfer the cut billets 10 one by one in lateral direction onto a turn table one by one.

The turn table 24 sends the billets 10 to the stationary welder 3 intermittently either regular or irregular interval. The discharge time of billets 10 can be set to t=30 sec. as given in the time chart of FIG. 2. Continuous processing of billets in the stationary welder 3 and the travelling welder 5 may be the same with the description given above. The turn table 24 is used as an example of the line-connecting unit, but the line-connecting unit is not limited to turn table.

Figure 4:
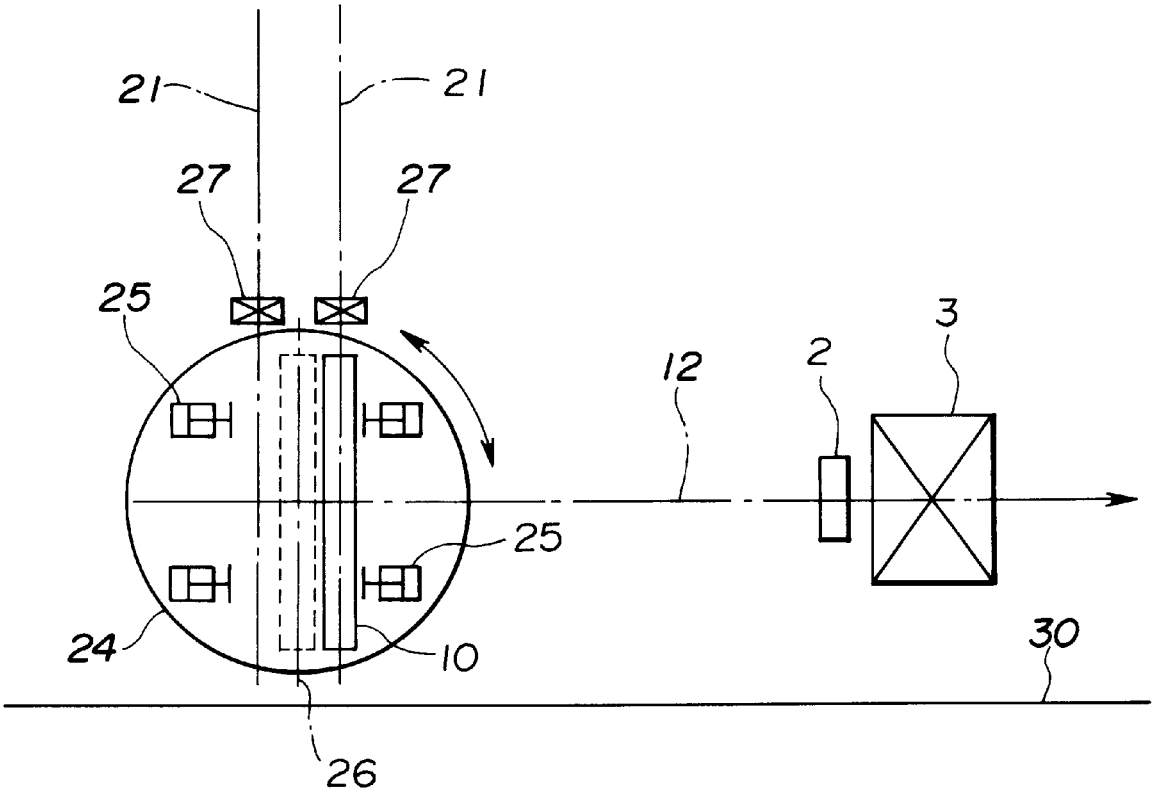
FIG. 4 illustrates an example of a turn table arrangement.

In the case of two-strand casting of billets, the turn table 24 may be configured as illustrated in FIG. 4. FIG. 4 shows a set of cylinder units 25 which push a billet 10 carried-in onto the turn table 24 in lateral direction relative to the billet length direction on the rotational center line 26 during the period of rotation of the turn table by a specified angle (for instance, 90°), and shows a disappearing stopper 27.

As described above, according to the present invention, a stationary welder and a travelling welder are located in a tandem arrangement. The stationary welder joins the billets to at least double length to the original single billet length by the flash-butt welding. Then, the travelling welder joins the entering double-length billet with the preceding long length billet by flash-butt welding to successively form a continuous billet. The conformation of the present invention provides a sufficient margin in the welding time, so the cycle time for processing a billet is shortened to 1 min. or less. Furthermore, the conformation according to the present invention needs no significant change of billet size in an existing apparatus because essentially the only additional installation is the stationary welder.

EMBODIMENT 2

The method of continuous rolling according to the embodiment 2 comprises the steps of: flash-butt welding a rear end of a preceding billet with a front end of a succeeding billet; grinding the welded portion to remove burrs therefrom; heating thus joined continuous billet; and continuously rolling the continuous billet through a line of rolling mill. Welders used in the step of flash-butt welding comprises a stationary welder and a travelling welder. The stationary welder is located in a first line different from a rolling line. The travelling welder is located in a second line matching the rolling line. The flash-butt welding step includes a first joining step and a second joining step. In the first joining step, the billets are joined to at least double the length of an original single billet using the stationary welder. In the second joining step, the joined billet is transferred intermittently from the first line to the second line, then the transferred joined billet is joined to the preceding continuous billet using the travelling welder.

Since the stationary welder joins billets each having a unit weight to at least double the length of an original single billet, the travelling welder is requested only to join these double-length billets. Accordingly, the flash-butt welding time has a sufficient margin. As a result, the cycle time for processing the billets can be reduced.

In the second joining step where the travelling welder functions, the billet feed speed is controlled in a manner that the feed speed of the preceding continuous billet in the second joining step is set to the same speed of entering thereof to the first stand in the rolling mill line, and that a feed control is given so as the succeeding double-length billet to catch up with the preceding continuous billet at a point of weld-start in the second step. The control avoids the billets from receiving excessive force and allows the implementation of continuous welding and continuous rolling of billets.

The method according to the embodiment 2 is applicable to a continuous rolling process using a heating furnace or to a hot direct-rolling process using a continuous casting machine. According to the former process, a heating furnace is located at upstream side of the stationary welder, and billets are discharged from the heating furnace at nearly fixed time interval shorter than the welding time in the second step. According to the latter process, a continuous casting machine which makes billets in a plurality of strands is located at upstream side of the stationary welder, and billets which were cut to a relatively short length are discharged from the heating furnace via a line-connecting unit at a nearly fixed time interval shorter than the welding time in the second step.

The method according to the embodiment 2 is particularly effective in such a case that, owing to the limitation of building shape and size, the arrangement of a continuous casting machine for multiple-train casting unavoidably requires to cut the billets to a short length, and that the welding cycle time takes 1 min. or more.

According to the hot direct-rolling process, no heating furnace is necessary, and the heat of billets is effectively used, so the billets are required only to be heated from about 920° C. at the exit of the continuous casting machine to the rolling temperature, or about 1020° C., using an induction heating unit, which accounts for about 100° C. of heating. As a result, the unit requirement for heating is significantly reduced.

A continuous rolling apparatus according to the embodiment 2 comprises:

a first line; a second line which is connected to the first line in parallel or at right angle thereto via a line-connecting unit; a stationary flash-butt welder which is located on the first line, and which joins billets to at least double the length of an original single billet; a travelling flash-butt welder which welds the double-length billet to a preceding continuous billet; a travelling grinding machine which grinds burrs on each welded portion; an induction heating unit which heats the continuous billet; and a continuous rolling mill which continuously rolls the continuous billet. The travelling welder, the travelling grinding machine and induction heating unit are arranged in this sequent order on the second line from upstream side.

Further, the continuous rolling apparatus according to the embodiment 2 has an arrangement of: a billet heating furnace at upstream side of the stationary welder; or a continuous casting machine which casts billets in a plurality of strands, and a line-connecting unit which intermittently connects billets which were cut to a relatively short length to the stationary welding machine, both of the continuous casting machine and the line-connecting unit being arranged at upstream side of the stationary welding machine.

Embodiment 2-1

Figure 5:
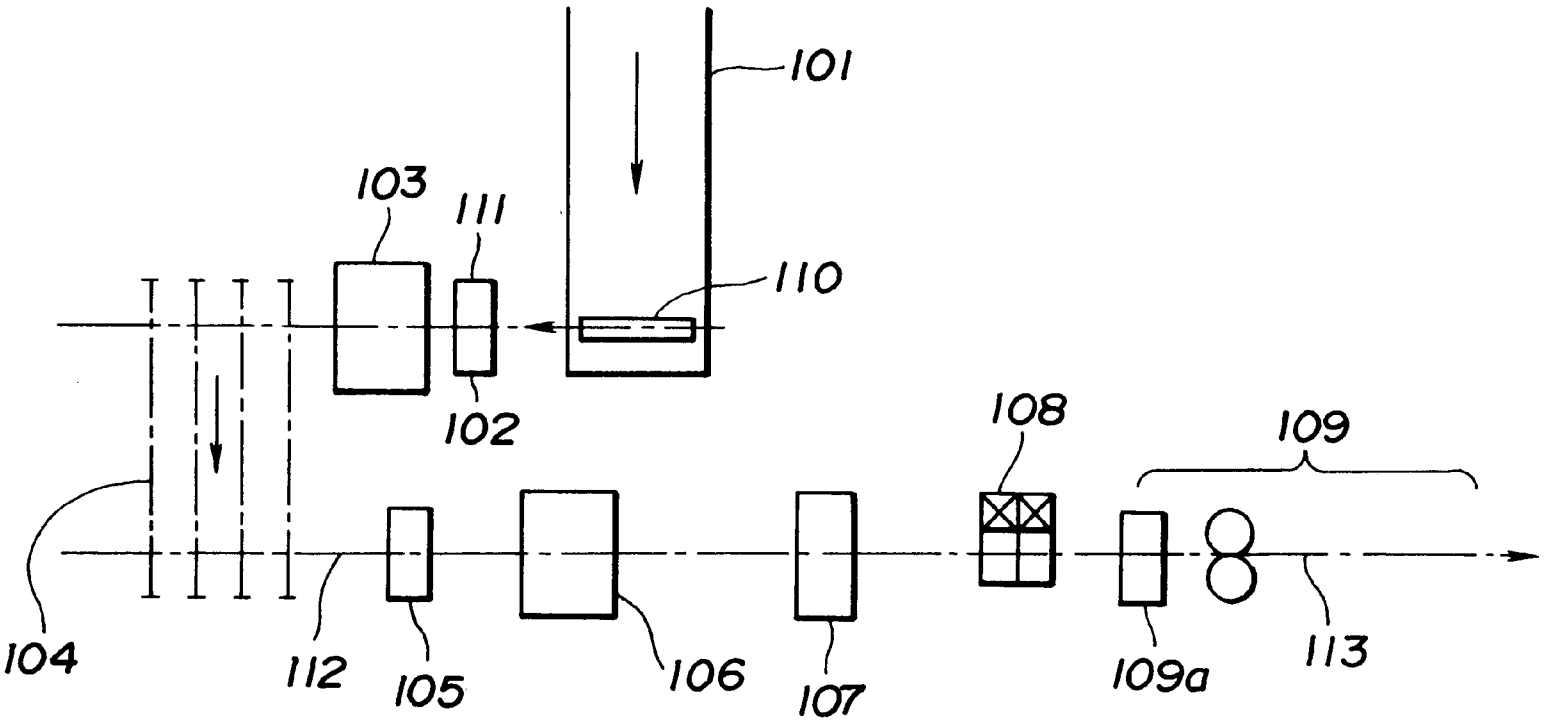
FIG. 5 is a schematic drawing of a manufacturing line of the continuous rolling process of embodiment 2-1 according to the present invention.

FIG. 5 is a schematic drawing of a manufacturing line of the continuous rolling process in embodiment 2-1 according to the present invention. A heating furnace 101 heats billet 110. A descaler 102 and a stationary flash-butt welder 103 (hereinafter referred to simply as "the stationary welder") are located on a first line 111. The first line 111 connects with a second line 112 via, for example, a line-connecting unit 104 comprising a plurality rows of chain conveyers. The second line 112 has a descaler 105, a travelling flash-butt welder 106 (hereinafter referred to simply as "the travelling welder"), a travelling grinding machine 107, an induction heating unit 108, and a continuous rolling mill 109, in a sequent order from upstream side. The figure shows a first stand 109*a* in the continuous rolling mill 109. The second line 112 matches a rolling line 113, and the first line 111 is in parallel with the second line 112.

The following is outline of method for joining billets in the continuous rolling apparatus configured as described above.

The billets 110 having a standard length are heated while passing through the heating furnace 101. Then the billets are discharged from the heating furnace 101 onto the first line 111 one at a time. After the first billet 110 is treated by the descaler 102 to remove scale on its front end and rear end, it is sent to the stationary welder 103, where the billet is stopped in the welder matching the rear end thereof to the center position of the welder. The positioning to stop may be done by a tracking control of a feed table or by a disappearing stopper. A billet 110 succeedingly discharged from the heating furnace 101 is sent to the stationary welder 103 via the descaler 102 in a same manner as the preceding billet 110, and the front end of the second billet is welded to the rear end of the first billet in the stationary welder 103 by the flash-butt welding. Thus, a billet having double-length to original one is formed as the first double-length billet.

The first double-length billet is transferred lateral to the first line 111 by a set of chain conveyers 104 from the first line 111 to the second line 112, then transferred on the second line 112 to enter the descaler 105, where the scale at front end and rear end thereof is removed. Then, the double-length billet enters the travelling welder 106, and is stopped therein feed control is then performed to enable. the second double-length billet to catch up with the first double-length billet at a point of weld-start. Thus the first and second double-length billets are joined together by flash-butt welding. The resulting billet has four-fold length to the original one. That is, a 4L billet is obtained (L denotes the length of original single billet.)

Then, the travelling welder 106 joins the 4L billet with succeeding 2L billet, and repeats the joining action to conduct continuous joining of billets.

The continuous billet thus formed is treated by the travelling grinding machine 107 to remove burrs at every welded portion, and is heated while passing through the induction heating unit 108 to a temperature necessary for rolling, or about 1020° C. And the continuous billet is continuously rolled in the continuous rolling mill 109.

Figure 6:
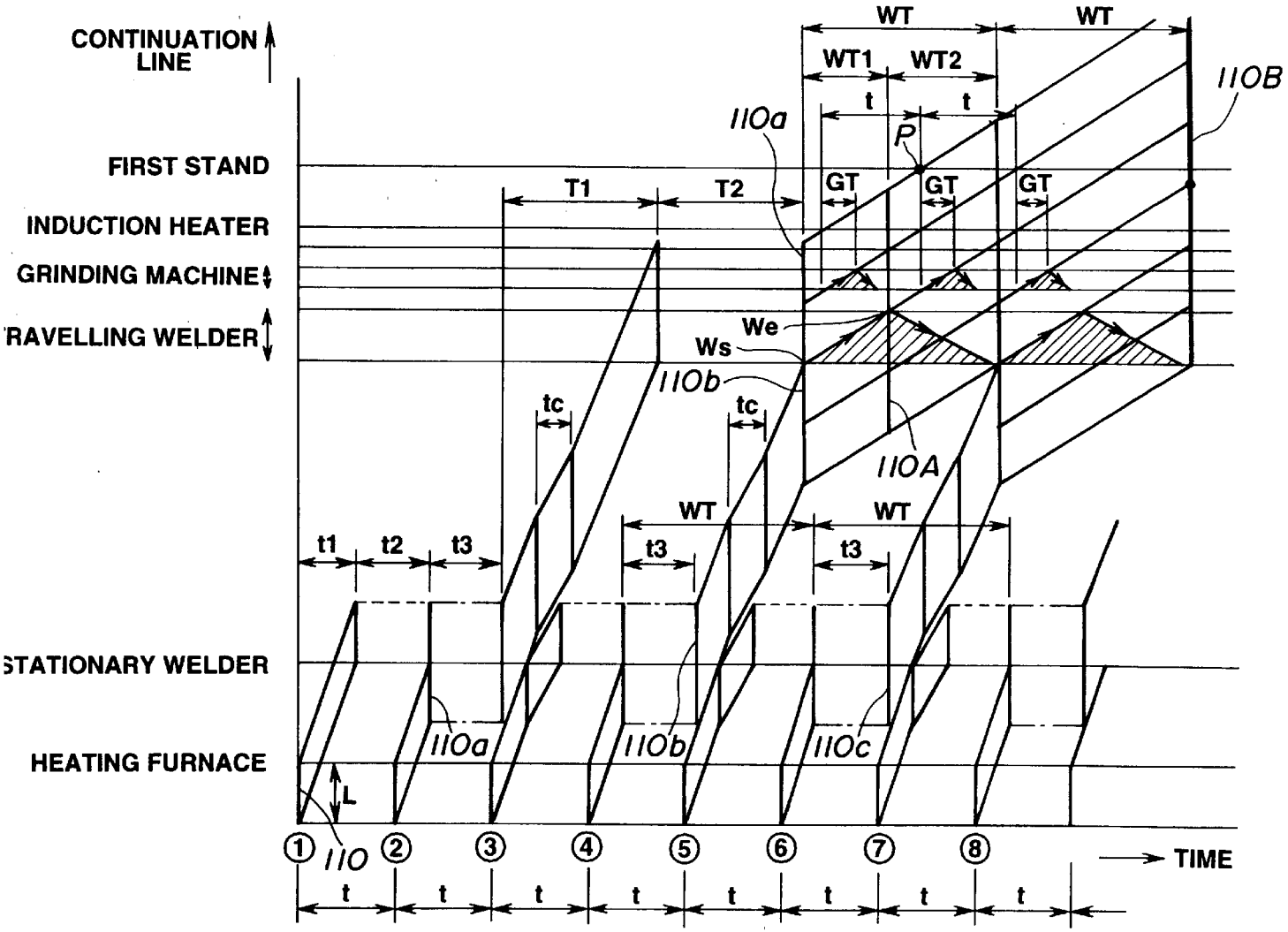
FIG. 6 is a time chart for embodiment 2-1.

The sequential actions described above all described in more detail referring to a time chart given in FIG. 6. The time chart shows the relation between time along the horizontal axis and distance between major machines and arrangement thereof along the vertical axis.

According to the example time chart, the time interval for discharging billet is 30 sec. The symbols ①, ②, . . . , ⑧ on the horizontal axis indicate the sequential order of discharge of billets 110. The symbol L along the vertical axis expresses the length of an original single billet.

The first billet ① is discharged from the heating furnace 101 onto the first line 111, and is sent to the stationary welder 103 (feed time t1), then is stopped at the center position of the stationary welder 103 matching the rear end of the billet ① thereto (waiting time t2).

After 30 sec. have passed, the second billet ② is discharged from the heating furnace 101 onto the first line 111, and is joined with the first billet ① by flash-butt welding. Thus formed double-length (2L) billet 1 10*a* comes first to be transferred toward the travelling welder 106 on the second line 112 via the chain conveyer 104 (transfer time T1, including tc of conveying time on the chain conveyer 104). The double-length billet stops to wait until the succeeding double-length billet 110*b* arrives (waiting time T2).

At nearly the same time that the first double-length billet 110*a* is started to move toward the travelling welder 106, the third billet ③ is discharged from the heating furnace 101, and the third billet ③ and the fourth billet ④ are joined together during the time T1 for transferring the double-length billet 110*a*. After the welding time t3, the second double-length billet 110*b* is sent toward the travelling welder 106 on the second line 112. At that moment, the feed of the double-length billet 110*b* is controlled so that the front end of the second double-length billet 110*b* catches up with the rear end of the first double-length billet 110*a* at the point Ws of weld-start. When the double-length billet 110*b* catches up with the double-length billet 110*a*, the travelling welder 106 begins to run, and the welding of the first double-length billet 110*a* and the second double-length billet 110*b* is completed at the point We. Then, the travelling welder 106 returns to the original position. The net welding time WT1 of the travelling welder 106 is about 24 sec., and the time chart is set to within 60 sec. of the total welding time WT including the returning time WT2. Thus, the first 4L billet 110A is fabricated. The feed speed of the 4L billet 110A is set to the entering speed of the billet into the first stand of the continuous rolling mill. The front end of the 4L billet 110A enters the first stand at the point P. The speed of the travelling welder 106 and that of the travelling grinding machine 107 are set to synchronize the billet entering speed to the first stand. Since the grinding time GT of burrs on a welded portion is significantly short, the grinding is sufficiently performed within a single billet cycle time.

In a same manner as described above, the fifth billet ⑤ and the sixth billet ⑥ are joined together in the stationary welder 103 to give a third double-length billet 110*c*. The third double-length billet 110*c* is joined to the preceding 4L billet 110A by the travelling welder 106, thus the billet is added by 2L length. That is, the billet 4L becomes a 6L billet 110B. Successive addition by 2L length provides 8L billet, 10L billet, and so on. Thus the billets becomes a continuous one, and the continuous billet is continuously rolled in the continuous rolling mill 109.

Accordingly, the travelling welder 106 needs to weld only 2L length portion, which gives a sufficient margin in the welding time inherent to the travelling welder. As a result, the welding is performed at a half cycle time compared with the cycle time of a single conventional travelling welder. The reason why the significant reduction in cycle time is achieved is that the stationary welder 103 prepares a billet with at least double length to the original one in advance. Even when these two units of welders 103, 106, are applied, they are located on different lines, 111, 112, respectively, so there are advantages such that the total line length is not extended, that the machine layout is easily done, and that existing apparatus is not requested for significant change of billet size.

Embodiment 2-2

Figure 7:
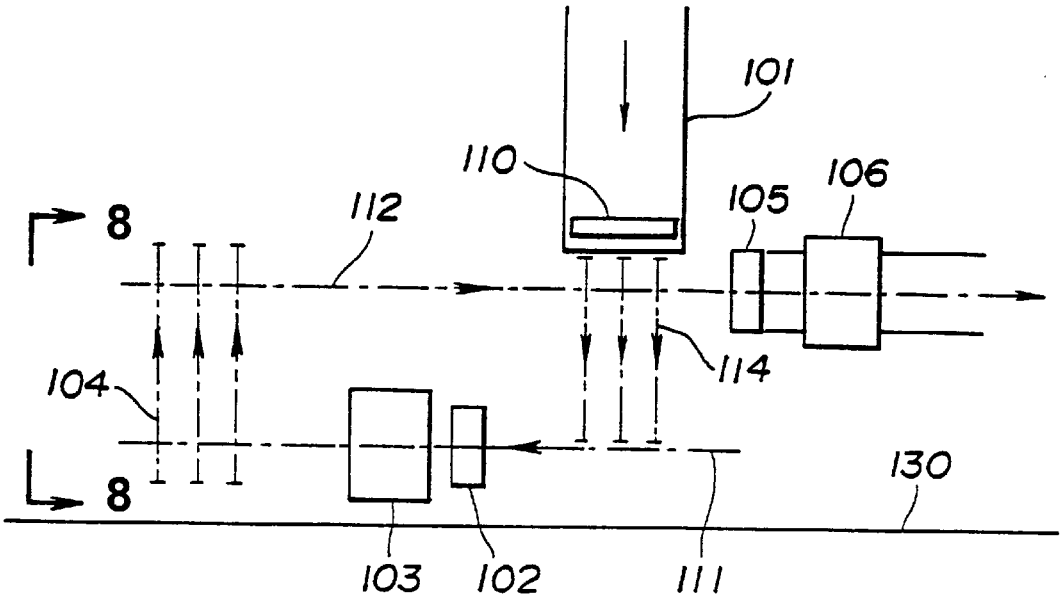
FIG. 7 is a schematic drawing of a manufacturing line of the continuous rolling process of embodiment 2-2 according to the present invention.
Figure 8:
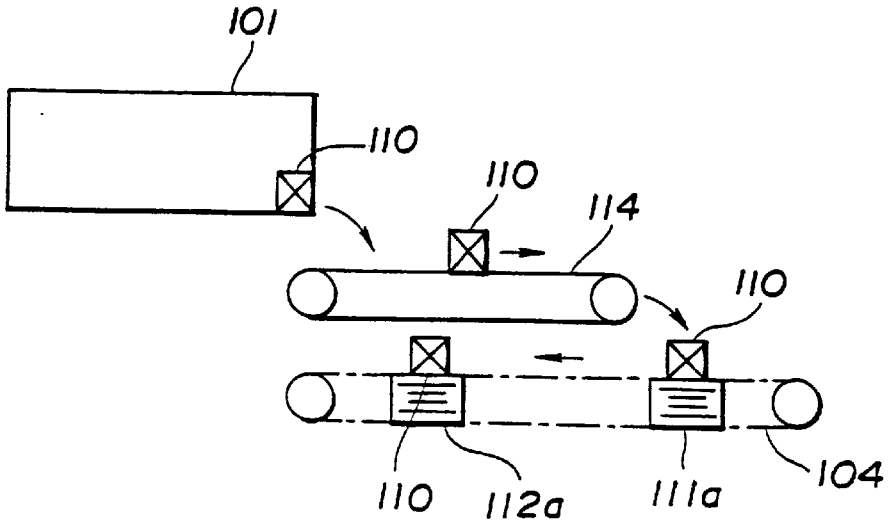
FIG. 8 is a view along 8—8 of FIG. 7.

FIG. 7 is a schematic drawing of a manufacturing line of the continuous rolling process of embodiment 2-2 according to the present invention. FIG. 8 is a view along line 8—8 of FIG. 7.

The example has an arrangement whereby the first line 111 and the second line 112 are located at downstream side of the heating furnace 1001. The billet 110 in the heating furnace 1001 is discharged onto a plurality rows of chain conveyers 114, then it is transferred in lateral direction relative to the axial direction of the heating furnace 1001. From the end of the chain conveyers 114, the billet 110 is brought onto the transfer rollers 111*a* on the first line 111. The billet 110 which was transferred by the transfer rollers 111*a* along the first line 111 is sent to the stationary welder 103 via the descaler 102, as described above, where the billet 110 is joined with a succeeding billet to form a double length to the original single billet length. The double-length billet 110 is then transferred from the first line 111 to the second line 112 via the conveyer 104, and it is sent along the second line 112 by the transfer rollers 112*a* beneath the chain conveyers 114 toward the travelling welder 106. Thus the billets 110 are successively joined to the preceding billet in the travelling welder 106.

The example is effective in the case that the heating furnace discharge table positions on the pass line and that the distance between the heating furnace and the inlet of rolling mill is short.

Embodiment 2-3

Figure 9:
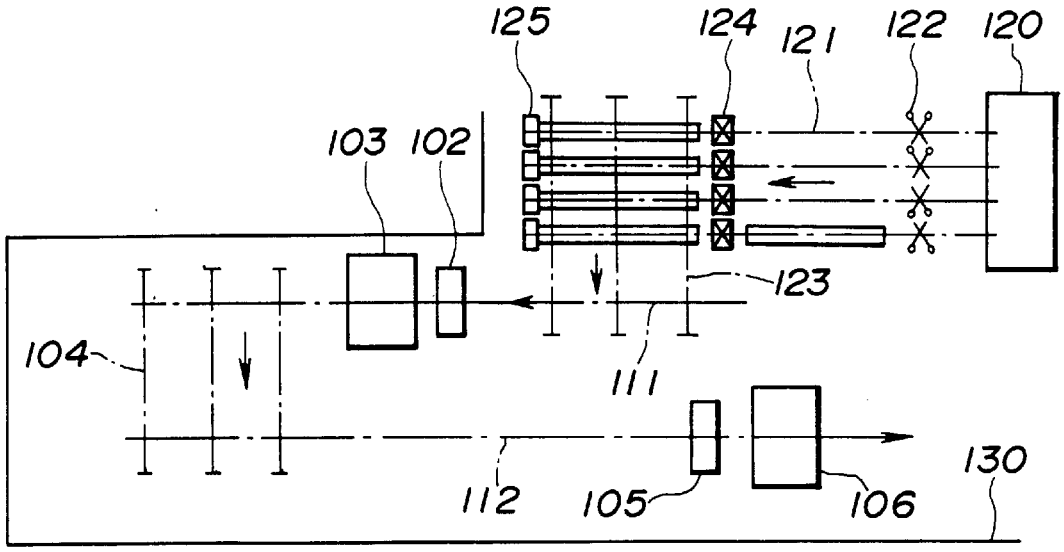
FIG. 9 is a schematic drawing of a manufacturing line of the continuous rolling process of embodiment 2-3 according to the present invention.

FIG. 9 is a schematic drawing of a manufacturing line of the continuous rolling process of embodiment 2-3 according to the present invention.

As described before, the present invention is also applicable to a hot direct rolling process using a continuous casting machine. This example is for the case of hot direct rolling process. A multiple-train continuous casting machine 120 is positioned in parallel with the rolling line 112 because of limitation of building 130 or the like, so that the billets 110 have to be cut to a short length. Even for the case, the present invention is applicable only by arranging the first line 111 and the second line 112 in parallel with the casting line 121. FIG. 9 shows a cutting machine 122, a set of chain conveyers 123 which transfer the cut billets one by one in lateral direction onto a first line 111, and a disappearing stopper 124, and a stopper 125.

The chain conveyers 123 send the billets 110 to the stationary welder 103 intermittently either regular or irregular interval. The discharge time of billets 110 can be set to t=30 sec. as given in the time chart of FIG. 6. Continuous processing of billets in the stationary welder 103 and the travelling welder 106 may be performed in the same manner described.

Embodiment 2-4

Figure 10:
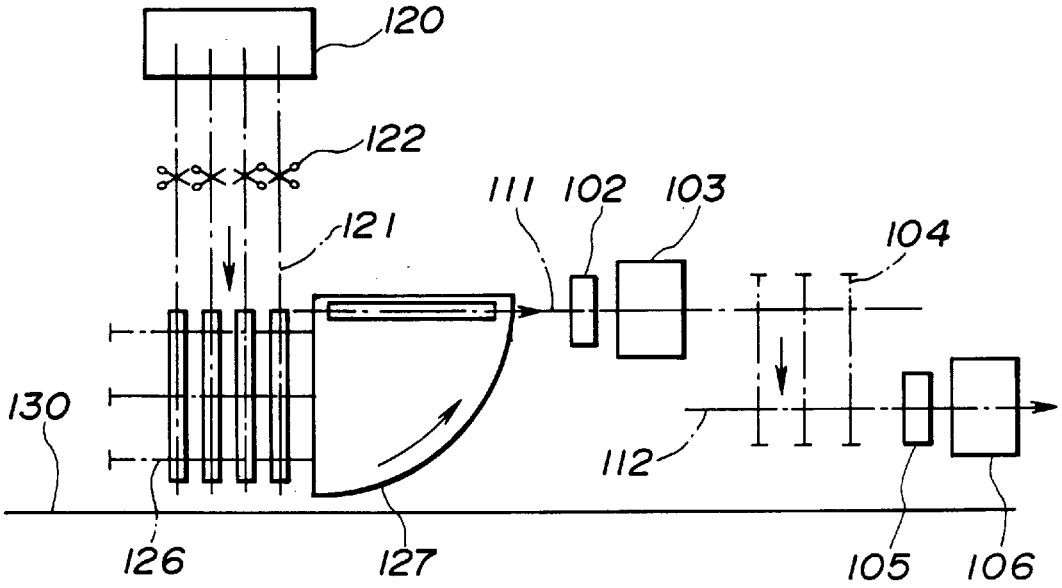
FIG. 10 is a schematic drawing of a manufacturing line of the continuous rolling process of embodiment 2-4 according to the present invention.

FIG. 10 is a schematic drawing of a manufacturing line of the continuous rolling process of embodiment 2-4 according to the present invention.

The example is for the case that a set of chain conveyers 126 and a turn table 127 are arranged as the line-connecting unit between the casting line 121 and the first line 111. Using this layout, direct rolling can be performed. If the chain conveyers 104 are replaced to a turn table, the first line 111 and the second line 112 are arranged to a right-angle location, though the case is not illustrated.

Figure 11:
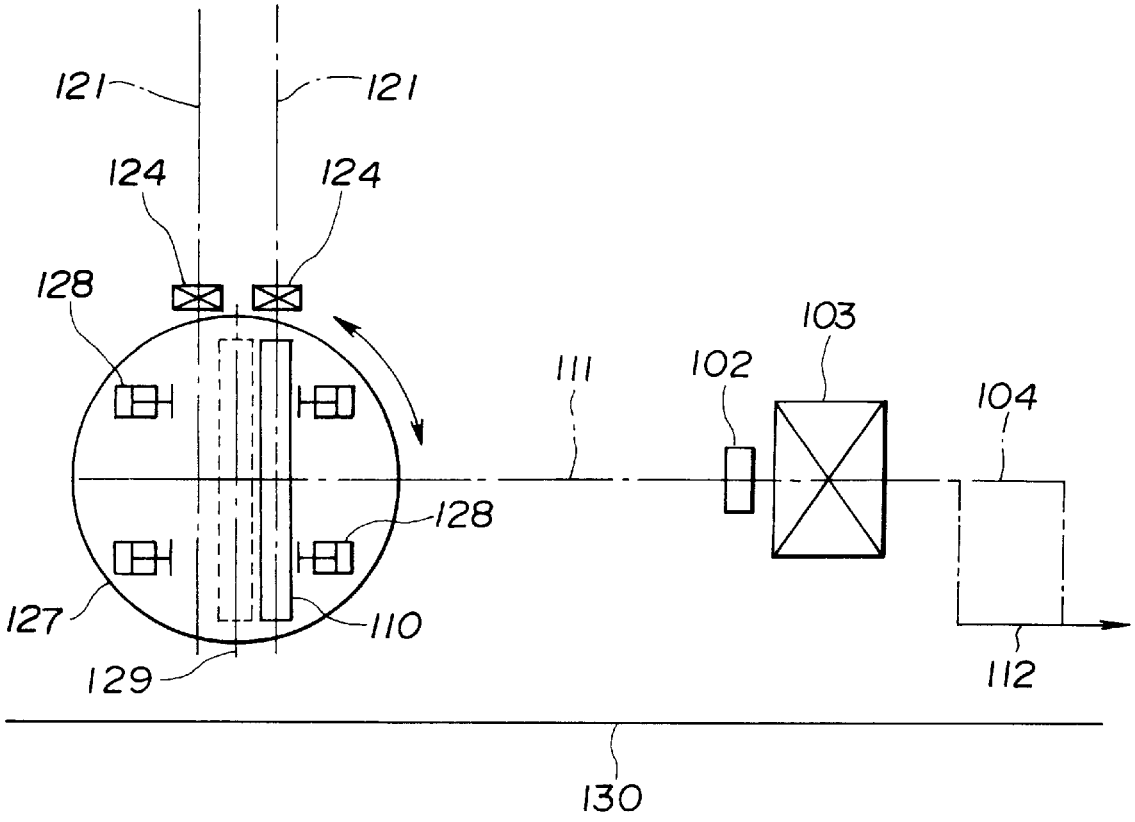
FIG. 11 illustrates another example of a turn table arrangement.

In the case of two-strand casting of billets, the turn table 127 may be configured as illustrated in FIG. 11. FIG. 11 shows a set of cylinder units 128 which push a billet 110 carried-in onto the turn table 127 in lateral direction relative to the billet length direction on the rotational center line 129 during the period of rotation of the turn table by a specified angle (for instance, 90°).

As described above, according to the present invention, a stationary welder and a travelling welder are located on each of different two lines, respectively. The stationary welder on the first line joins the billets to at least double length to the original single billet length. Then, thus prepared double-length billet is sent to the second line via a line-connecting unit, which second line matches a rolling line. The travelling welder on the second line joins the entering double-length billet with the preceding long length billet by flash-butt welding to successively form a continuous billet. The conformation of the present invention provides a sufficient margin in the welding time at the travelling welding machine, so the cycle time for processing a billet is shortened to 1 min. or less. Furthermore, the conformation according to the present invention needs no significant change of billet size in an existing apparatus.

What is claimed is:

1. A continuous rolling apparatus comprising:

a stationary flash-butt welder for joining a rear end of a preceding billet with a front end of a succeeding billet to produce a double-length billet having a first welded portion;

a travelling flash-butt welder, arranged in series with the stationary welder, for joining a front end of the double-length billet with a rear end of a continuous billet to produce an extended continuous billet having a second welded portion;

a travelling grinding machine for grinding burrs on the first welded portion and the second welded portion;

an induction heater for heating the extended continuous billet; and a continuous rolling mill for continuously rolling the extended continuous billet.

2. The continuous rolling apparatus of claim 1, further comprising a heating furnace, provided upstream of the stationary flash-butt welder, for heating the preceding and succeeding billets.

3. The continuous rolling apparatus of claim 1, further comprising a continuous casting machine having a plurality of strands for making the preceding and succeeding billets, and a line-connecting unit for intermittently feeding the preceding and succeeding billets to the stationary flash-butt welder.

4. A continuous rolling apparatus comprising:

a first line;

a second line;

a line-connecting unit for connecting the first line and the second line in a manner such that the first line and the second line are either substantially parallel to each other or substantially at right angles to each other;

a stationary flash-butt welder provided in the first line for joining a rear end of a preceding billet with a front end of a succeeding billet to produce a double-length billet having a first welded portion;

a travelling flash-butt welder provided in the second line for joining a front end of the double-length billet with a rear end of a continuous billet to produce an extended continuous billet having a second welded portion;

a travelling grinding machine for grinding burrs on the first welded portion and the second welded portion;

an induction heater for heating the extended continuous billet; and a continuous rolling mill for continuously rolling the extended continuous billet.

5. The continuous rolling apparatus of claim 4, further comprising a heating furnace, provided upstream of the stationary flash-butt welder, for heating the preceding and succeeding billets.

6. The continuous rolling apparatus of claim 4, further comprising a continuous casting machine having a plurality of strands for making the preceding and succeeding billets, and wherein the line-connecting unit intermittently feeds the preceding and succeeding billets to the stationary flash-butt welder.

7. A continuous rolling method comprising:

a first flash-butt welding step of using a stationary welder to join a rear end of a preceding billet with a front end of a succeeding billet to produce a double-length billet;

a second flash-butt welding step of using a travelling welder, which is arranged in series with the stationary welder, to join a front end of the double-length billet with a rear end of a continuous billet to produce an extended continuous billet having a welded portion;

a step of grinding the welded portion of the extended continuous billet to remove a burr therefrom;

a step of heating the extended continuous billet from which the burr has been removed; and a step of continuously rolling the extended continuous billet through a series of rolling mills.

8. The continuous rolling method of claim 7, further comprising a step of controlling a feed speed of the continuous billet such that the feed speed of the continuous billet in the second flash-butt welding step is the same as a speed at which the extended continuous billet enters a first stand in the series of rolling mills, and such that the double-length billet catches up with the continuous billet at a point of weld-start in the second flash-butt welding step.

9. The continuous rolling method of claim 7, further comprising a step of heating the preceding and succeeding billets in a heating furnace before the first flash-butt welding step, and a step of discharging the heated billets from the heating furnace at a time interval which is shorter than a welding time in the second flash-butt welding step.

10. The continuous rolling method of claim 7, further comprising initial steps of forming the preceding and succeeding billets in a continuous casting machine having a plurality of strands, and directly feeding the preceding and succeeding billets to the stationary welder through a line-connecting unit at a time interval which is shorter than a welding time in the second flash-butt welding step.

11. A continuous rolling method comprising:

a first flash-butt welding step of using a stationary welder provided in a first line to join a rear end of a preceding billet with a front end of a succeeding billet to produce a double-length billet;

a step of intermittently transferring the double-length billet to a second line matching a rolling line;

a second flash-butt welding step of using a travelling welder provided in the second line to join a front end of the double-length billet with a rear end of a continuous billet to produce an extended continuous billet having a welded portion;

a step of grinding the welded portion of the extended continuous billet to remove a burr therefrom;

a step of heating the extended continuous billet from which the burr has been removed; and a step of continuously rolling the extended continuous billet through a series of rolling mills.

12. The continuous rolling method of claim 11, further comprising a step of controlling a feed speed of the continuous billet such that the feed speed of the continuous billet in the second flash-butt welding step is the same as a speed at which the extended continuous billet enters a first stand in the series of rolling mills, and such that the double-length billet catches up with the continuous billet at a point of weld-start in the second flash-butt welding step.

13. The continuous rolling method of claim 11, further comprising a step of heating the preceding and succeeding billets in a heating furnace before the first flash-butt welding step, and a step of discharging the heated billets from the heating furnace at a time interval which is shorter than a welding time in the second flash-butt welding step.

14. The continuous rolling method of claim 11, further comprising initial steps of forming the preceding and succeeding billets in a continuous casting machine having a plurality of strands, and directly feeding the preceding and succeeding billets to the stationary welder through a line-connecting unit at a time interval which is shorter than a welding time in the second flash-butt welding step.

* * * * *